US007535483B2

(12) United States Patent
Takada et al.

(10) Patent No.: US 7,535,483 B2
(45) Date of Patent: May 19, 2009

(54) IMAGE FORMING APPARATUS AND IMAGE FORMING METHOD

(75) Inventors: Kazumasa Takada, Shizuoka-ken (JP); Hidenori Kobayashi, Shizuoka-ken (JP); Shunichi Ono, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 412 days.

(21) Appl. No.: 11/459,929

(22) Filed: Jul. 25, 2006

(65) Prior Publication Data

US 2008/0024588 A1 Jan. 31, 2008

(51) Int. Cl.
*B41J 2/435* (2006.01)
*B41J 2/47* (2006.01)

(52) U.S. Cl. ..... 347/237; 347/247

(58) Field of Classification Search ..... 347/116, 347/132, 133, 236, 237, 246, 247; 430/31
See application file for complete search history.

(56) References Cited

U.S. PATENT DOCUMENTS 4,794,413 A * 12/1988 Yamazaki et al. ..... 347/247
5,099,260 A * 3/1992 Sato et al. ..... 347/116
5,380,610 A * 1/1995 Haneda et al. ..... 430/31
5,687,002 A * 11/1997 Itoh ..... 347/133

FOREIGN PATENT DOCUMENTS

JP 59037570 A * 3/1984
JP H02-58019 2/1990
JP 2000-71510 A 3/2000
JP 2003-320703 A 11/2003

* cited by examiner

*Primary Examiner*—Hai C Pham
(74) *Attorney, Agent, or Firm*—SoCal IP Law Group LLP; Steven C. Sereboff; John E. Gunther

(57) ABSTRACT

An image forming apparatus of the invention includes plural photoconductive bodies for forming a color image, an exposure unit to scan a laser light in a main scanning direction of each of the plural photoconductive bodies and to perform exposure, and a light amount correction unit to create, for each of the plural photoconductive bodies, light amount correction data for correcting a light amount of the laser light outputted form the exposure unit so that a light receiving sensitivity of each of the plural photoconductive bodies in the main scanning direction becomes uniform, and the light amount correction unit includes a first storage unit to store reference correction data, a second storage unit to store reference correction data, a second the reference correction data is made an absolute amount, by a relative amount correspondingly to each of the plural photoconductive bodies, and a combining unit to combine the reference correction data and the relative correction data to create the light amount correction data.

14 Claims, 13 Drawing Sheets

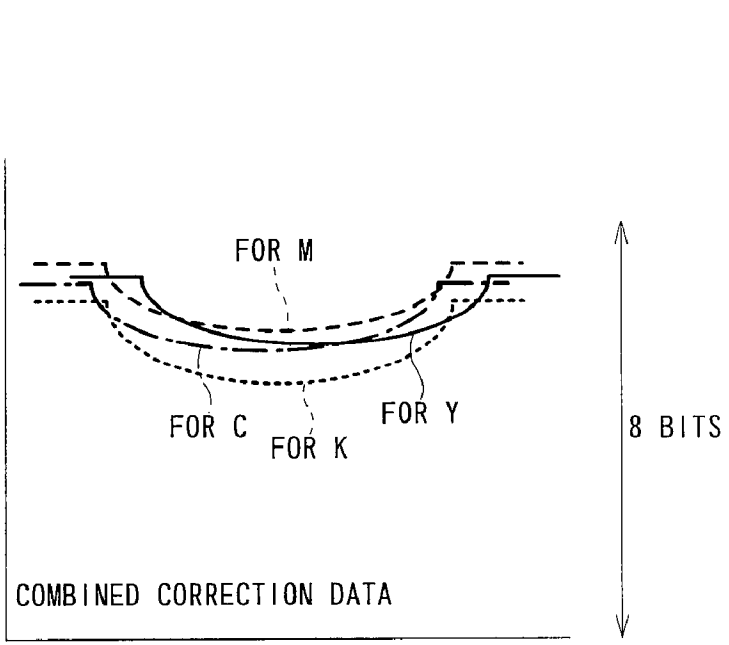
FIG. 8C
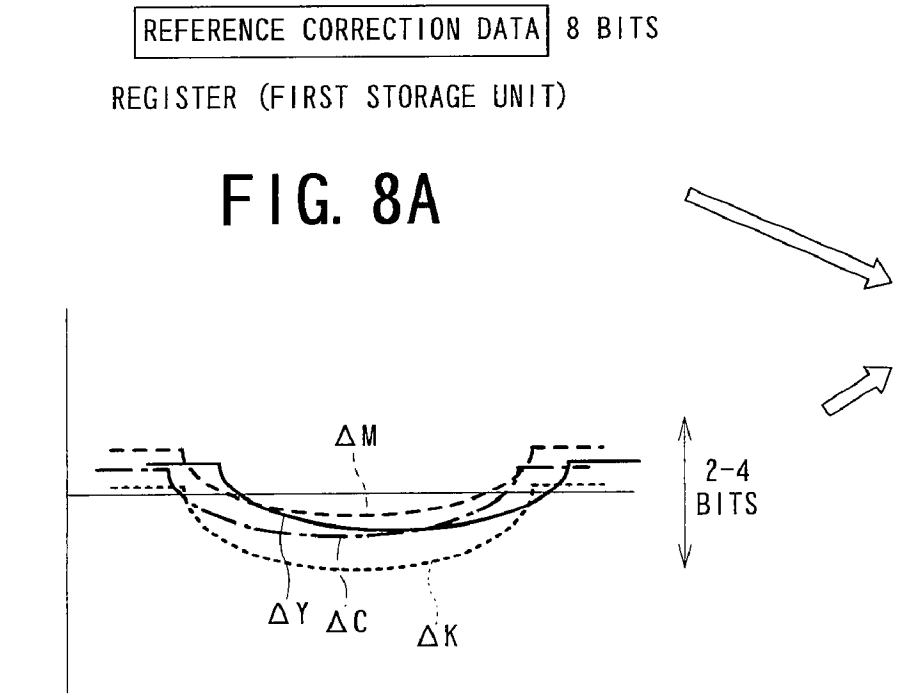
FIG. 8B
FIG. 8A

IMAGE FORMING APPARATUS AND IMAGE FORMING METHOD

BACKGROUND OF THE INVENTION

1. Technical Field of the Invention

The present invention relates to an image forming apparatus and an image forming method, and particularly to an image forming apparatus and an image forming method using an electrophotographic system.

2. Related Art

In recent years, various image forming apparatuses, such as digital copiers and laser printers, to perform image formation by scanning exposure using a laser light beam and an electrophotographic process have been developed.

The image forming apparatus includes a beam light scanning device to scan the laser light beam onto a photoconductive drum to form an electrostatic latent image on the photoconductive drum. The beam light scanning device includes, for example, a laser oscillator to generate the laser light beam, a polygon mirror to reflect the laser light beam outputted from the laser oscillator toward the photoconductive drum and to scan it onto the photoconductive drum, an f-θ lens and the like.

The electrostatic latent image formed on the photoconductive drum is toner-developed, and the toner-developed image is finally transferred as a recording image to a recording sheet. Accordingly, in order to form a uniform recording image without unevenness, it becomes necessary to form the electrostatic latent image of uniform intensity on the photoconductive drum, and it becomes important to stabilize the intensity of the laser light beam.

However, the intensity of the laser light beam irradiated onto the photoconductive body (photoconductive drum) is not necessarily constant in the beam scanning direction. The main cause is that the transmission loss of the f-θ lens varies according to the incident angle. In general, the incident angle of the laser light beam to the f-θ lens is almost vertical at the center of the f-θ lens, and is obliquely incident on a place close to the end of the f-θ lens. As a result, the transmission loss of the f-θ lens is least at the center, and becomes large toward the end.

This means that from the viewpoint of the intensity of the laser light beam irradiated onto the photoconductive drum, the intensity of the laser light beam is highest at the center of the f-θ lens, and it becomes weak toward the end, and the intensity of the laser light beam becomes uneven in the main scanning direction.

Besides, in a tandem system color image forming apparatus, in the case where a polygon mirror to scan a laser light is used commonly to four colors, a structure is such that the laser light is distributed to photoconductive bodies of respective colors by the mirror, and in addition to the irregularity of the mirror itself, since an incident angle to the mirror varies according to the lasers of the respective colors, even if the same laser light beam power is set, the laser light powers on the drum surfaces of the respective colors are different from each other.

JP-A 2003-320703 or the like discloses a method in which the laser light power of a laser light source is made low at the vicinity of the center of the lens according to the scanning position of the laser, and is made high at the end of the lens, so that the difference in power loss due to the transmissivity cancels out, the laser light power on the surface of the photoconductive drum is uniformed, and the exposure amount is made constant.

In the techniques disclosed in these, light amount correction values corresponding to the scan positions of the laser are prepared, and the adjustment of the laser light power is performed based on the light amount correction values.

Heretofore, with respect to the light amount correction values, the same memory capacity is secured for each of the colors, the absolute amount of the correction values is stored, and a correction circuit of correcting the light amount has a circuit structure of such a system that the value, the absolute amount of the correction value is directly used.

It is necessary that the correction circuit of the light amount processes a large amount of image data at real time, and high speed is required. Thus, it is necessary that the processing from the reading of the correction value to the D/A conversion is processed by the hardware, and a memory (RAM: Random Access Memory) to store these correction values is incorporated in an ASIC (Application Specific Integrated Circuit) or the like or a dedicated high speed RAM is used.

In the conventional system, when the light amount correction is performed, when the resolution of correction (the resolution here means two resolutions of 1) the resolution relating to the number of divided blocks in the main scanning direction, and 2) the resolution relating to the number of bits of a D/A converter used at the correction) is improved, the RAM capacity is increased in proportion thereto. Since picture quality required for an image forming apparatus becomes finer by a recent technical advance, these correction amounts tend to increase, and in the system in which the correction values are stored in all RAMs as they are, the increase of the correction information causes the increase of the RAM capacity, and causes the increase of cost.

SUMMARY OF THE INVENTION

The invention has been made in view of the above circumstances, and it is an object to provide an image forming apparatus in which in an image forming apparatus of an electrophotographic system, a light amount correction, in a main scanning direction, of laser light to expose a photoconductive body can be realized with a small memory capacity while keeping correction accuracy, and an image forming method.

In order to achieve the above object, the image forming apparatus according to an aspect of the invention includes plural photoconductive bodies for forming a color image, an exposure unit configured to scan a laser light in a main scanning directions of each of the photoconductive bodies and to perform exposure, and a light amount correction unit configured to create, for each of the plural photoconductive bodies, light amount correction data for correcting a light amount of the laser light outputted from the exposure unit so that a light receiving sensitivity of each of the plural photoconductive bodies in the main scanning direction becomes uniform, and the light amount correction unit includes a first storage unit configured to store reference correction data, a second storage unit configured to store relative correction data represented, when the reference correction data is made an absolute amount, by a relative amount correspondingly to each of the plural photoconductive bodies, and a combining unit configured to combine the reference correction data and the relative correction data to create the light amount correction data.

Besides, in order to achieve the above object, the image forming method according to another aspect of the invention is the image forming method of an image forming apparatus including plural photoconductive bodies for forming a color image, and an exposure unit configured to scan a laser light in a main scanning direction of each of the plural photoconductive bodies and to perform exposure, and includes a light amount correction step of creating, for each of the plural photoconductive bodies, light amount correction data for correcting a light amount of the laser light outputted from the exposure unit so that a light receiving sensitivity in the main scanning direction of each of the plural photoconductive bodies becomes uniform, and the light amount correction step includes storing reference correction data into a first storage unit, storing relative correction data represented, when the reference correction data is made an absolute amount, by a relative amount into a second storage unit correspondingly to each of the plural photoconductive bodies, and combining the reference correction data and the relative correction data to create the light amount correction data.

BRIEF DESCRIPTION OF THE DRAWINGS

In the attached drawings:

FIGS. 8A to 8C are views for explaining a second operation example of the light amount correction unit according to the first embodiment;

DETAILED DESCRIPTION OF THE PREFERRED EMBODIMENTS

Embodiments of an image forming apparatus and an image forming method of the invention will be described with reference to the accompanying drawings.

(1) Structure of the Image Forming Apparatus

Figure 1:
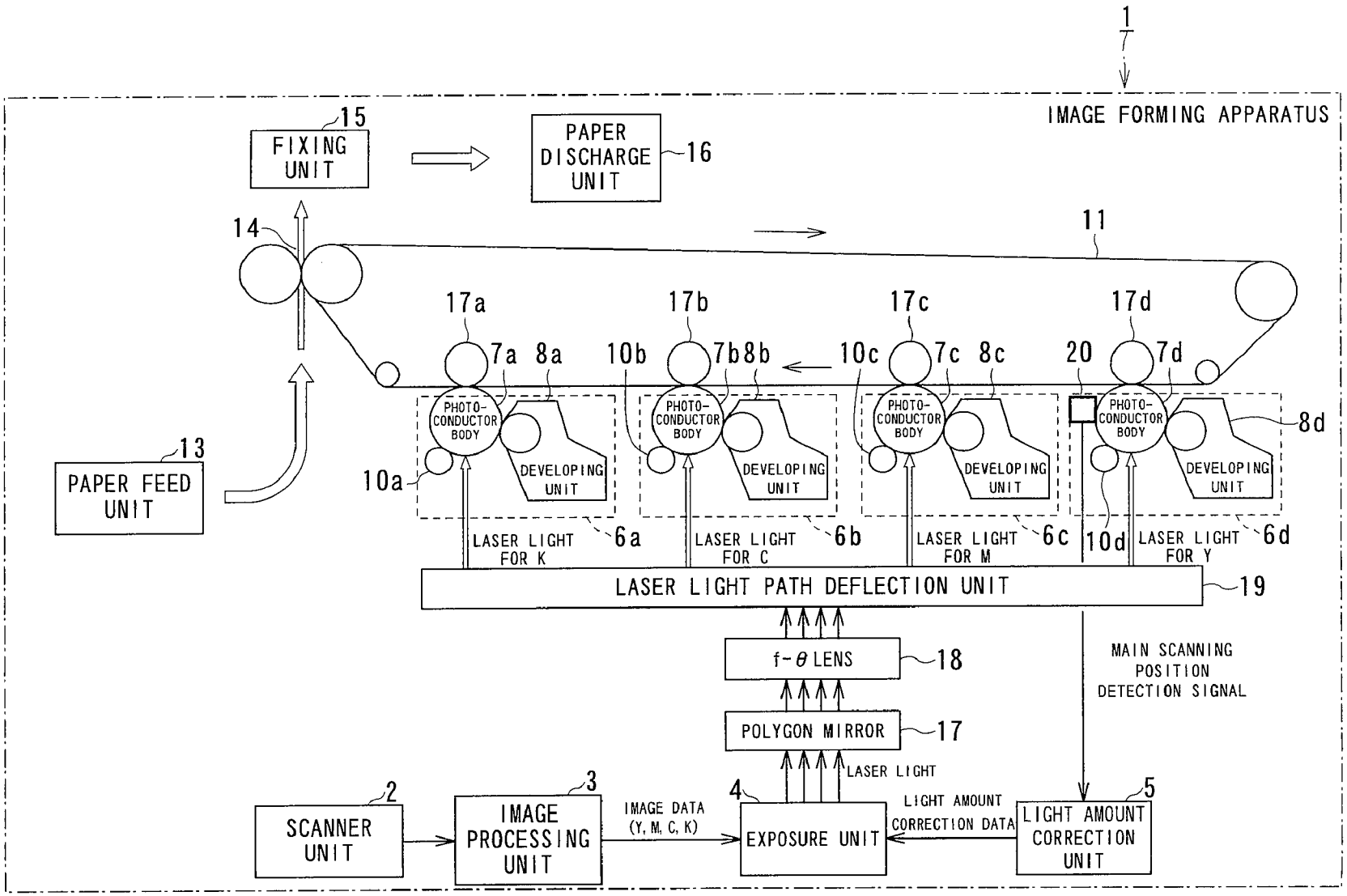
FIG. 1 is a view showing an example of a whole structure of an image forming apparatus according to a first embodiment of the invention.

FIG. 1 is a view showing a structural example of an image forming apparatus 1 according to an embodiment. As shown in FIG. 1, the image forming apparatus 1 is, for example, a tandem type color copier. The image forming apparatus 1 includes a scanner unit 2, an image processing unit 3, an exposure unit 4, a light amount correction unit 5, a polygon mirror 17, an f-θ lens 18, a laser light path deflection unit 19, process cartridges 6*a*, 6*b*, 6*c* and 6*d*, an intermediate transfer belt (transfer-receiving member) 11, intermediate transfer rollers (transfer units) 17*a*, 17*b*, 17*c* and 17*d*, a paper feed unit 13, a recording sheet transfer unit 14, a fixing unit 15 and a paper discharge unit 16.

In the scanner unit 2, a document is read, and image data of, for example, three primary colors of R, G and B are created. In the image processing unit 3, color conversion processing from the three primary colors of R, G and B to four print colors of K (black), C (cyan), M (magenta) and Y (yellow) is performed on the respective image data, and further, various image processings are performed.

The image-processed K signal, C signal, M signal and Y signal are inputted to the exposure unit 4. The exposure unit 4 includes a laser oscillator (not shown) and generates laser lights corresponding to the intensities of the K signal, the C signal, the M signal and the Y signal.

The laser light generated by the exposure unit 4 is scanned by the polygon mirror 17 and the f-θ lens 18 in the main scanning direction, and is irradiated to photoconductive bodies 7*a*, 7*b*, 7*c* and 7*d* in the process cartridges 6*a*, 6*b*, 6*c* and 6*d* through the laser light path deflection unit 19.

The process cartridges 6*a*, 6*b*, 6*c* and 6*d* correspond to the four colors for color printing, including the four process cartridges for the K signal, the C signal, the M signal and the Y signal, and are structured to be attachable/detachable to/from the image forming apparatus 1. The basic structures of the respective process cartridges 6*a*, 6*b*, 6*c* and 6*d* are the same although the colors of toners included in developing units 8*a*, 8*b*, 8*c* and 8*d* are different. Then, in the following description concerning the process cartridge, the suffixes of a, b, c and d attached to reference numerals will be omitted and the description will be made.

The process cartridge 6 includes the photoconductive body 7, the developing unit 8, and a charging device 10. The surface of the photoconductive body 7 is charged to a specified potential by the charging device 10, and the electrostatic latent image is formed on the surface by the laser light irradiated from the exposure unit 4. The electrostatic latent image is developed with the toner supplied from the developing unit 8, and the developed image corresponding to each toner color is formed on the surface of the photoconductive body 7.

The developed image formed on the photoconductive body 7 is superimposed and transferred onto the intermediate transfer belt 11 in the order of Y, M, C and K, and at the time point when it passes through the photoconductive body 7*a* for K, full color toner images in which the four colors are combined are formed on the intermediate transfer belt 11.

The toner images on the intermediate transfer belt 11 are transferred in the recording sheet transfer unit 14 to the recording sheet supplied from the paper feed unit 13. The toner images transferred to the recording paper are fixed to the recording sheet in the fixing unit 15, and it is discharged to the outside from the paper discharge unit 16.

Although four laser lights generated in the exposure unit 4 reach the respective photoconductive bodies 7 through the polygon mirror 17, the f-θ lens 18, and the laser light path deflection unit 19, since paths of the respective colors are not necessarily completely identical to each other, attenuation amounts are slightly different in the respective colors. Besides, as described before, since the transmissivity of the f-θ lens 18 is high at the center and low at both ends, it does not become uniform in the main scanning direction of the photoconductive body.

Further, the output characteristic of the laser oscillator and the sensitivity characteristic of the photoconductive body 7 are influenced by aging and environmental change.

In order to correct the irregularity and the change of the characteristics, correction of the power of a laser light is generally adopted, and this correction is performed based on the light amount correction data generated by the light amount correction unit 5.

(2) Light Amount Correction (First Embodiment)

Before a light amount correction of the image forming apparatus 1 according to the first embodiment of the invention is described, a light amount correction generally performed will be roughly described.

Figure 2:
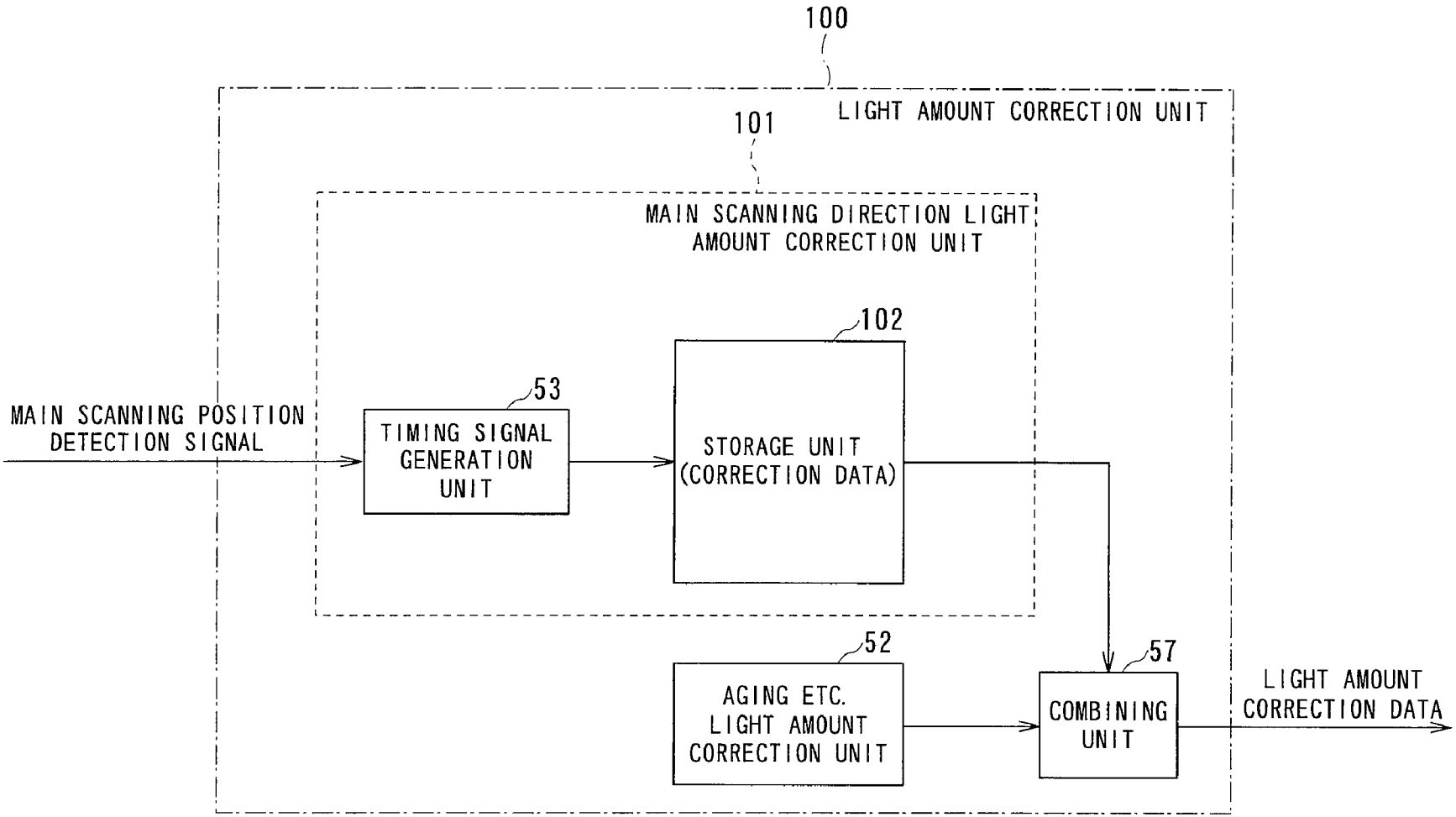
FIG. 2 is a view showing a structural example of a light amount correction unit of a normal mode.

FIG. 2 is a view showing an example of a structure of a light amount correction unit 100 for performing the general light amount correction. The light amount correction includes a light amount correction in a main scanning direction and a light amount correction of aging or the like.

The light amount correction in the main scanning direction is performed by a main scanning direction light amount correction unit 101 in FIG. 2, and the correction of the transmissivity of the f-θ lens 18 in the main scanning direction is mainly performed.

On the other hand, the light amount correction of aging or the like is performed by an aging etc. light amount correction unit 52. These two kinds of correction values are combined, and the combined correction data is outputted as light amount correction data from the light amount correction unit 100 to the exposure unit 4.

The exposure unit 4 determines the laser light powers of Y, M, C, K based on the light amount correction data and the image data outputted from the image processing unit 3, and supplies them to the photoconductive body 7.

Figures 3A, 3B, 3C, 3D:
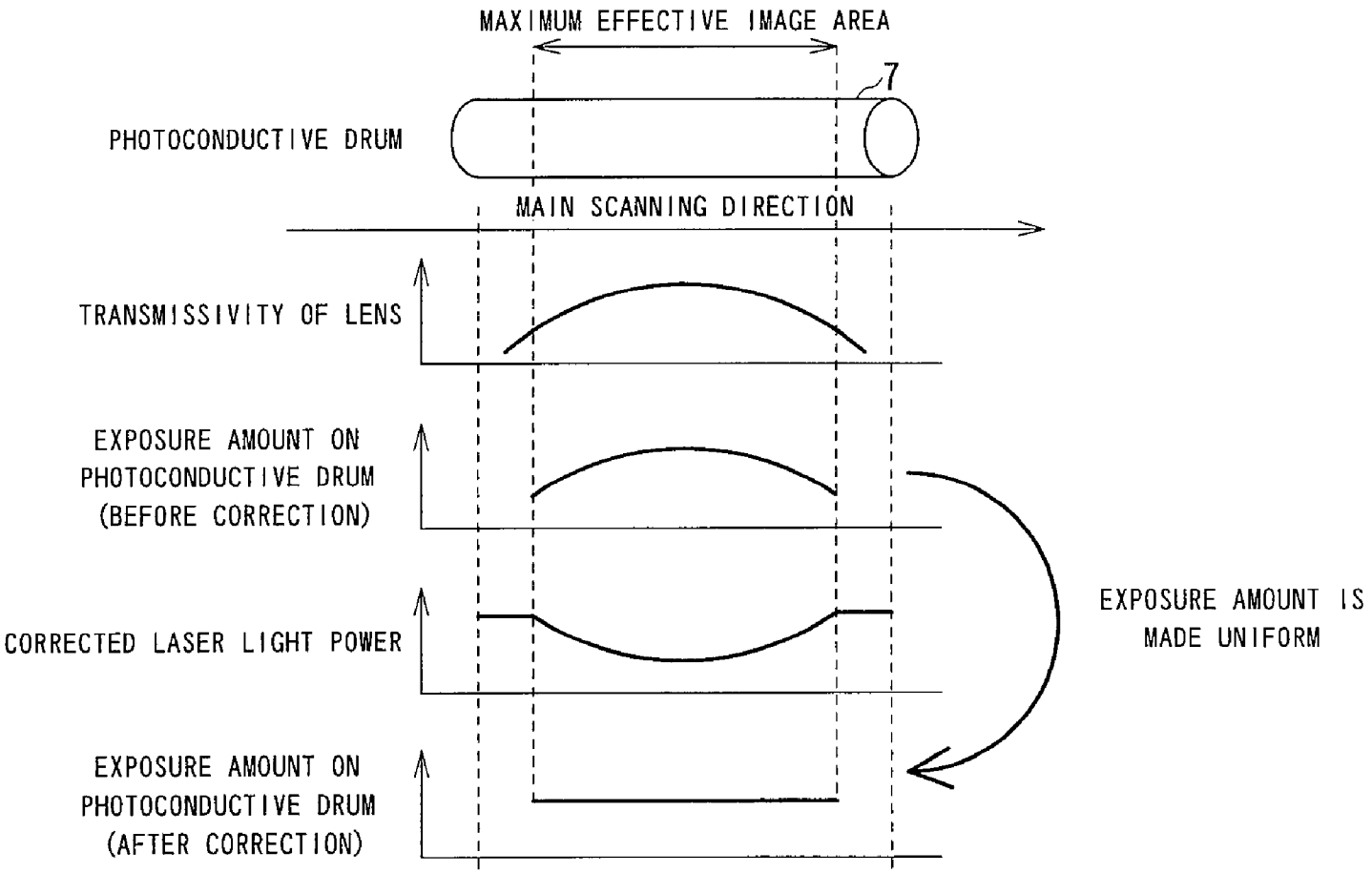
FIGS. 3A to 3D are views for explaining the concept of a light amount correction in a main scanning direction.

FIG. 3A is a view showing the transmissivity of the f-θ lens 18 in the main scanning direction. As shown in FIG. 3A, the transmissivity of the f-θ lens 18 is high at the center in the main scanning direction and is low at both ends.

Thus, the exposure amount (FIG. 3B) of the photoconductive drum (photoconductive body) 7 before correction is high at the center and is low at both ends. As a result, the density of an image formed becomes irregular in the main scanning direction.

To cope with this problem, as shown in FIG. 3C, a correction is performed so that the power of the laser light of the exposure unit 4 is low at the center and is high at both ends, and the exposure amount in the main scanning direction becomes uniform (FIG. 3D).

The correction data of the laser light power is previously stored in a storage unit 102 of the main scanning direction light amount correction unit 101, and the correction data is read from the storage unit 102 at a timing of the main scanning of the laser light.

A timing signal for reading, for example, a read control signal of the storage unit 102 or address data is generated by a timing signal generating unit 53 based on a detection signal (main scanning position detection signal) from a laser light sensor 20 (see FIG. 1) disposed in the vicinity of the photoconductive body 7.

Since scanning in the main scanning direction is performed at high speed, the timing signal generation unit 53 is generally constructed of a hardware logic circuit, and is often constructed as an ASIC (Application Specific Integration Circuit) for miniaturization. Besides, since the storage unit 102 requires high speed reading, it is constructed of dedicated high speed REM. The high speed RAM may be incorporated in the ASIC.

Figure 4:
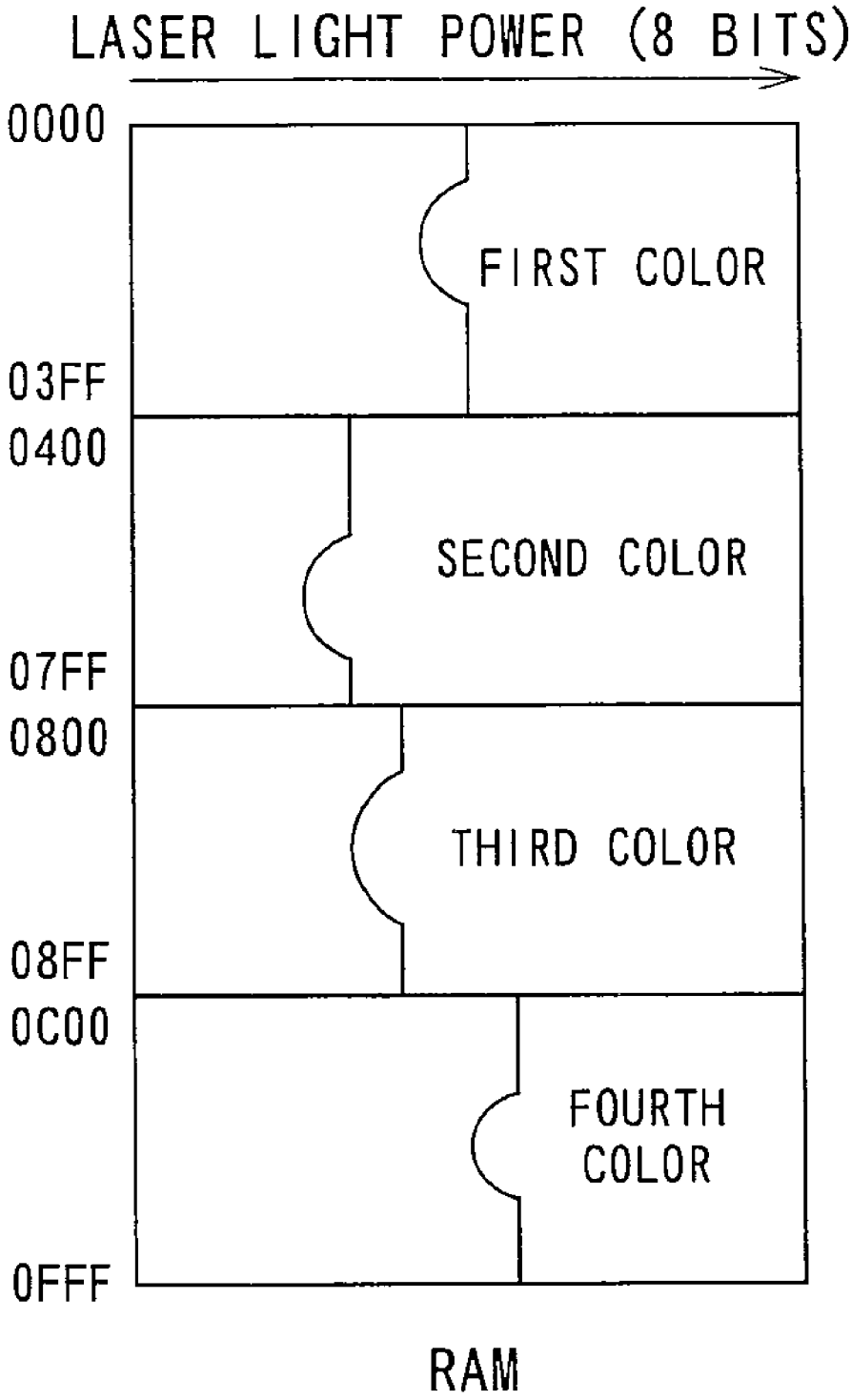
FIG. 4 is a view showing a memory allocation example of a storage unit to store light amount correction data in the main scanning direction in the normal mode.

FIG. 4 is a view showing an example of a memory allocation and content of light amount correction data which have been conventionally generally adopted when the light amount correction data in the main scanning direction is stored in the storage unit 102. The vertical direction of FIG. 4 indicates the address of RAM to represent the memory allocation, and the horizontal direction indicates the magnitude of the light amount correction data.

In the example of FIG. 4, as an area to store the light amount correction data of a first color (for example, Y), an address area of from "0000" to "03FF" is allocated, and the width of the data is 8 bits.

As shown in FIG. 1, the respective laser lights of Y, M, C and K have different paths as paths from the exposure unit 4 to the photoconductive bodies 7. Especially, in the laser light path deflection unit 19, in order to guide the laser light outputted from the f-θ lens 18 to the respective photoconductive bodies 7 physically disposed at different positions, mirrors and lenses are used in the respective paths of Y, M, C and K, and the optical characteristics of these are not necessarily the same. Besides, the reflection characteristics of the polygon mirror 17 are different from each other in the respective paths of Y, M, C and K in a precise sense.

Therefore, as shown in FIG. 4, the correction data in the main scanning direction is stored for each of the first color to the fourth color (Y, M, C, K), thus different correction data can be obtained.

Further, conventionally, each of the light amount correction data is stored as "absolute amount" for each of the colors as it is. That is, the light amount correction data stored in the storage unit 102 is directly D/A converted as it is, and is applied to the laser oscillator of the exposure unit 4.

However, when a demand for high picture quality is raised as in recent times, the need for more finely performing the light amount correction in the main scanning direction has been intensified. Thus, it is necessary to raise both the resolution of the correction in the main scanning direction (that is, the resolution in such a meaning that a division is made into how many blocks in the main scanning direction and the correction is performed) and the resolution of the correction data (that is, the resolution in such a meaning that as the magnitude of the correction data, the correction data of how many bits is formed).

The improvement of the resolution in the main scanning direction increases the RAM address in FIG. 4, and the improvement of the resolution of the correction data increases the width (bit number) of the correction data. Both increase the RAM capacity.

Thus, it is an important problem that the RAM capacity is reduced while the accuracy (fineness) of the correction is made high, and the point of the invention is to solve this problem, Hereinafter, the light amount correction according to embodiments of the invention will be described.

Figure 5:
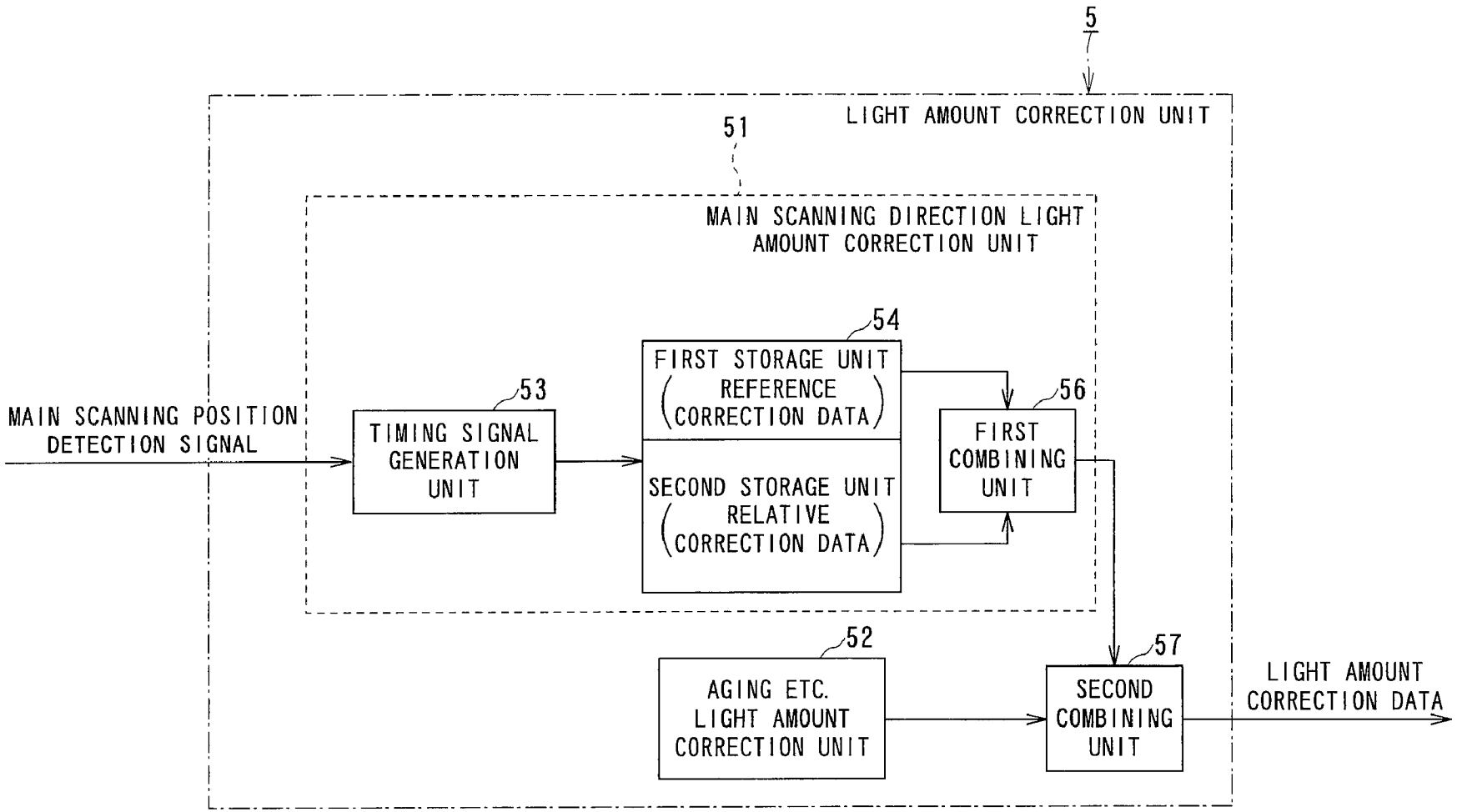
FIG. 5 is a view showing a structural example of a light amount correction unit according to the first embodiment of the invention.

FIG. 5 is a view showing a structural example of the light amount correction unit 5 according to the first embodiment.

The light amount correction unit 5 includes a main scanning direction light amount correction unit 51 to create light amount correction data in the main scanning direction, an aging etc correction unit 52 to create correction data to aging, environmental change or the like, and a second combining unit 57 to combine these correction data by addition/subtraction and the like.

The main scanning direction light amount correction unit 51 includes, as its inner structure, a timing signal generation unit 53, a first storage unit 54, a second storage unit 55, and a first combining unit 56.

The first embodiment is the embodiment in which specified areas of a RAM are allocated as the first storage unit 54 and the second storage unit 55. One light amount correction data selected as reference correction data among the light amount correction data for Y, M, C and K is stored in the first storage unit 54 of these. Besides, difference data relative to the reference correction data is stored as relative correction data in the second storage unit 55.

Figure 6A:
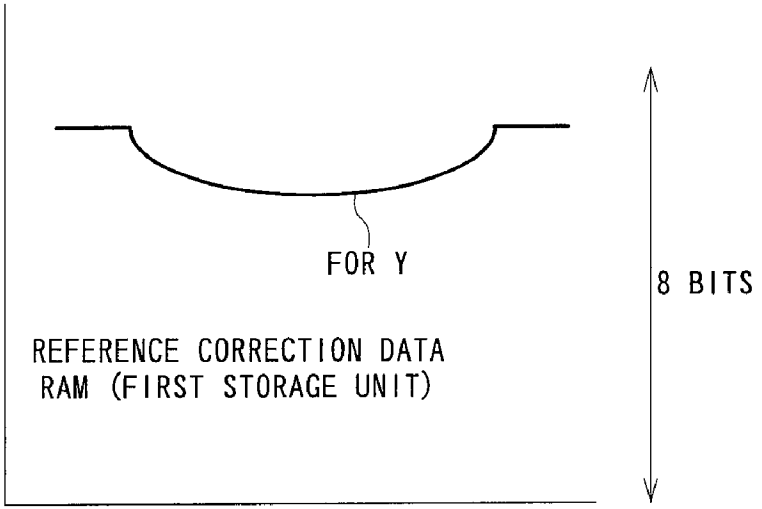
FIGS. 6A to 6C are views for explaining a first operation example of the light amount correction unit according to the first embodiment.
Figure 6B:
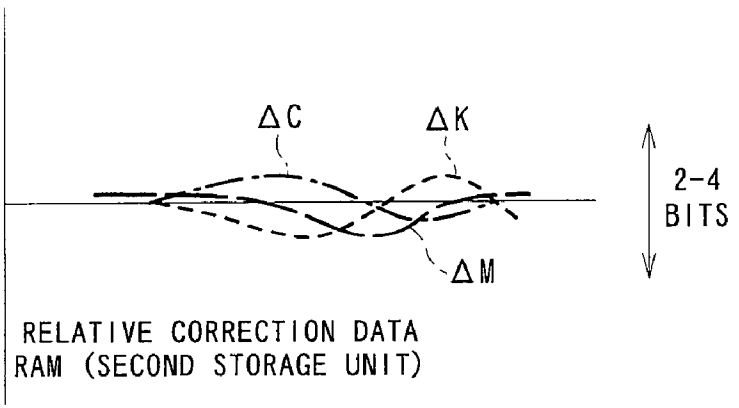

For example, as exemplified in FIG. 6A, as the reference correction data, the light amount correction data for Y is stored as an absolute amount into the first storage unit 54 as it is, whereas as exemplified in FIG. 6B, difference data ΔM, ΔC and ΔK between the light amount correction data for Y and the respective light amount correction data for M, C and K are stored as relative correction data into the second storage unit 55.

The respective light amount correction data for Y, M, C and K are the correction data relatively close to each other although the values are different. Thus, the values of the difference data ΔM, ΔC and ΔK are small values as compared with the absolute amount of the light amount correction data.

When the light amount correction data for Y as the reference correction data is represented by a size of 8 bits, the values of the difference data ΔM, ΔC and ΔK can be small values of, for example, about 2 to 4 bits.

Figure 7:
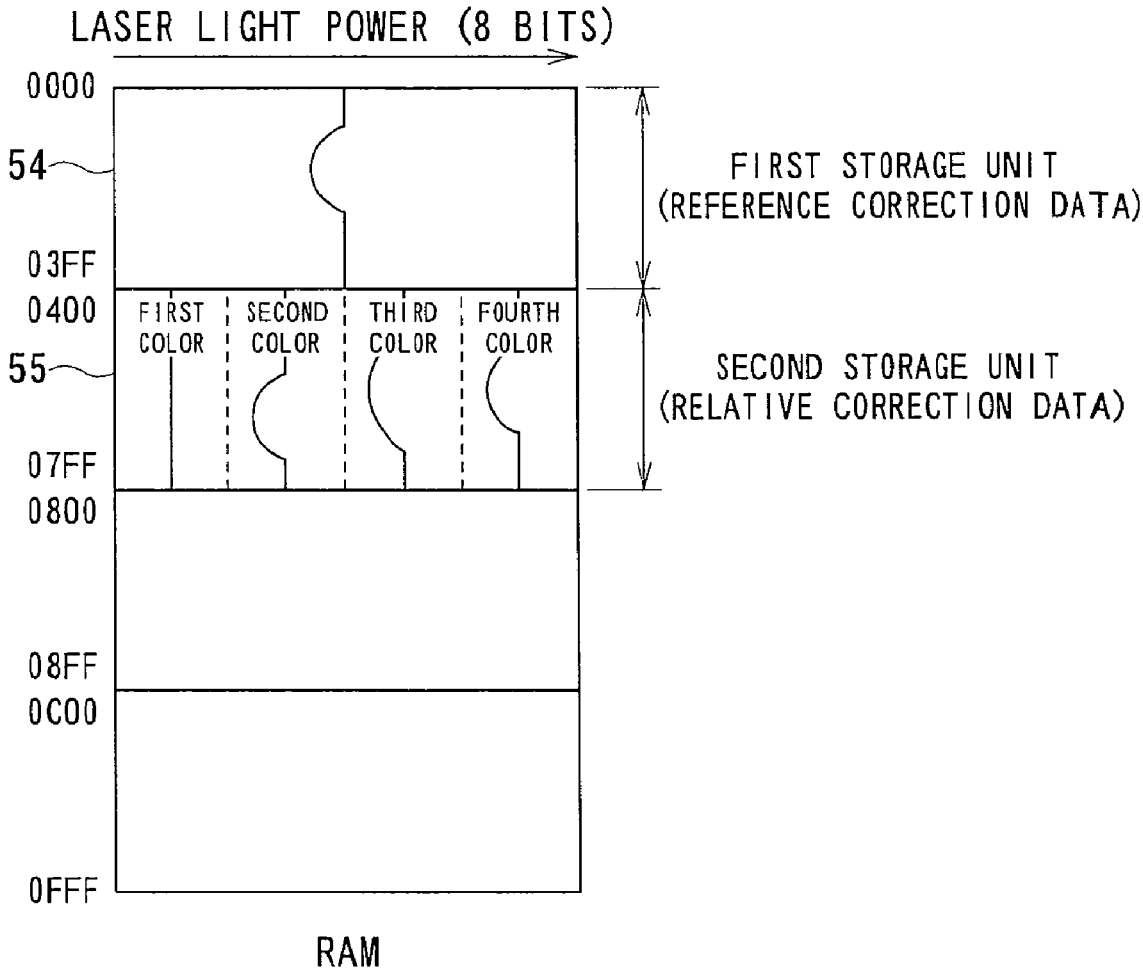
FIG. 7 is a view showing a memory allocation example, corresponding to the first operation example, of a first and a second storage units according to the first embodiment.

Thus, as exemplified in FIG. 7, the light amount correction data for Y is stored in an area (first storage unit 54) of addresses of from "0000" to "03FF" of the RAM, and the difference data ΔM, ΔC and ΔK as the relative correction data can be collectively stored in an area (second storage unit 55) of addresses of from "0400" to "07FF", and as compared with the conventional area use mode (see FIG. 4) of the RAM, it becomes possible to greatly save the storage area.

Figure 6C:
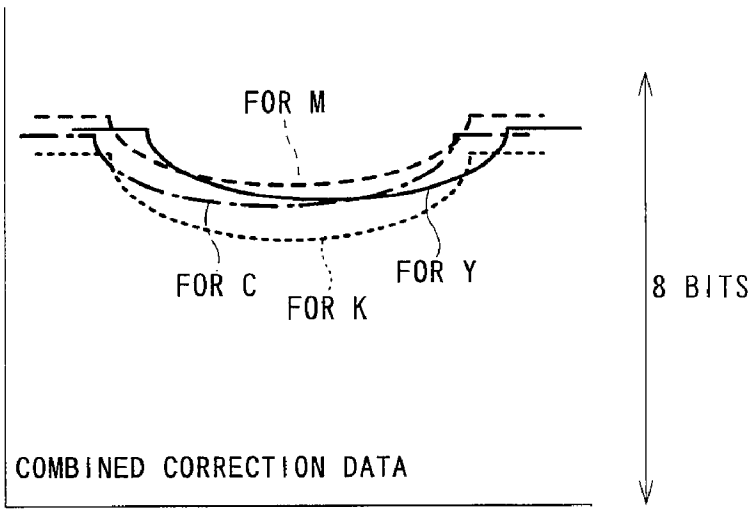

The reference correction data stored in the first storage unit 54 and the relative correction data stored in the second storage unit 55 are added and combined in the first combining unit 56, and as shown in FIG. 6C, they become main scanning direction light amount correction data of the full range (8 bits) corresponding to the respective colors.

The main scanning direction light amount correction data is added to and combined with the aging etc. light amount correction data in the second combining unit 57, and is outputted as final light amount correction data to the exposure unit 4.

As kinds of the reference correction data and the relative correction data, various modes are conceivable in addition to this.

For example, as shown in FIGS. 8A to 8C and FIGS. 9A and 9B, there is a method in which an average value or a center value of all light amount correction data for Y, M, C and K is determined as one reference correction data, and difference data ΔY, ΔM, ΔC and ΔK relative to the average value or the center value are made relative correction data.

Figure 9B:
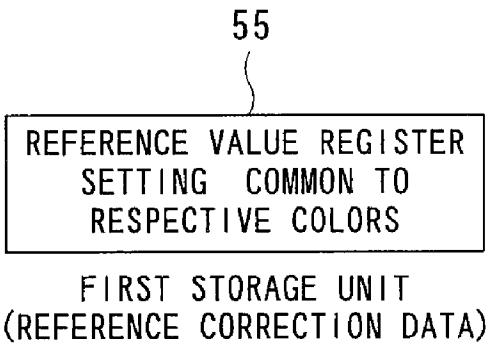
FIGS. 9A and 9B are views showing a memory allocation example, corresponding to a second operation example, of the first and the second storage units according to the first embodiment.
Figure 9A:
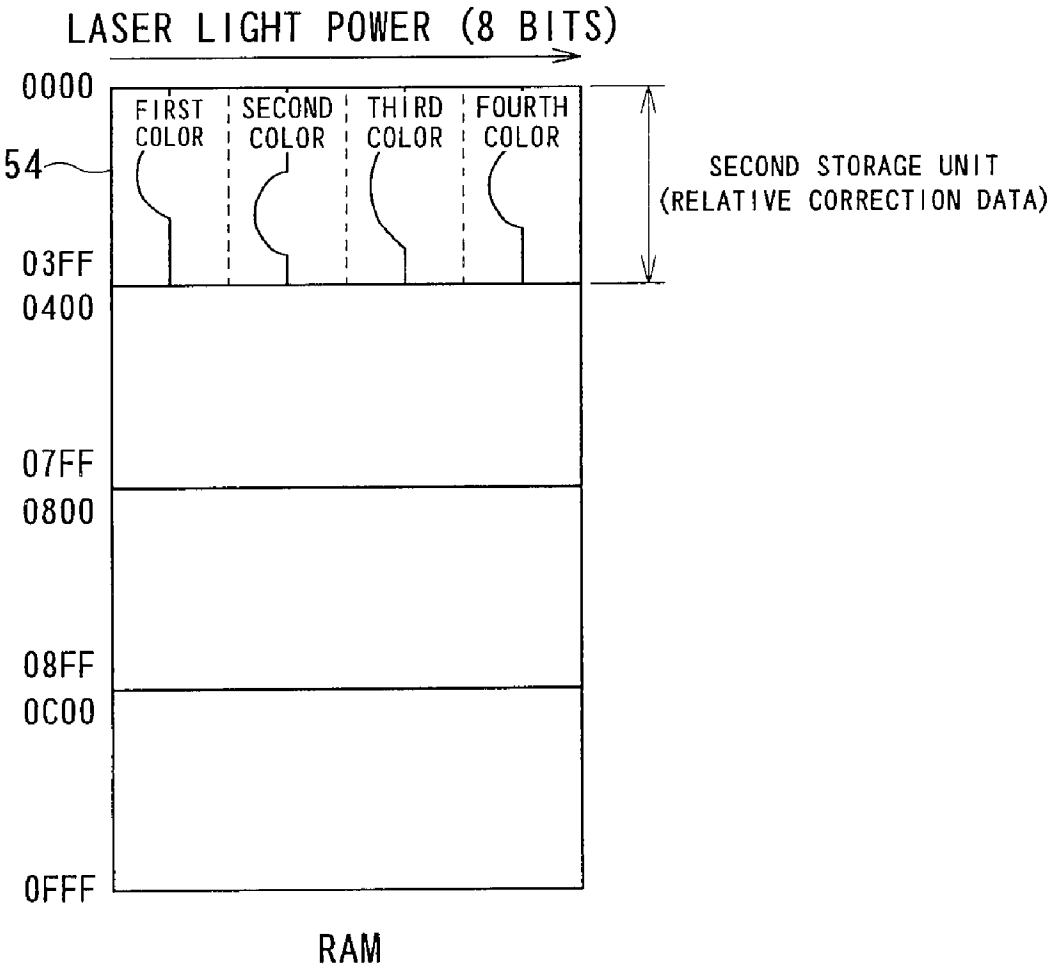

In this case, since the reference correction data becomes one value, it is unnecessary to store it in the RAM, and as shown in FIG. 8A and FIG. 9B, it may be stored in one register, and the RAM area can be further saved.

In addition, for example, as shown in FIGS. 10A to 10C and FIGS. 11A and 11B, there is a method in which an average value or a center value of each of light amount correction data for Y, M, C and K is determined as reference correction data relative to each of the light amount correction data, and respective difference data ΔY, ΔM, ΔC and ΔK to the average value or the center value are made relative correction data.

Figure 10A:
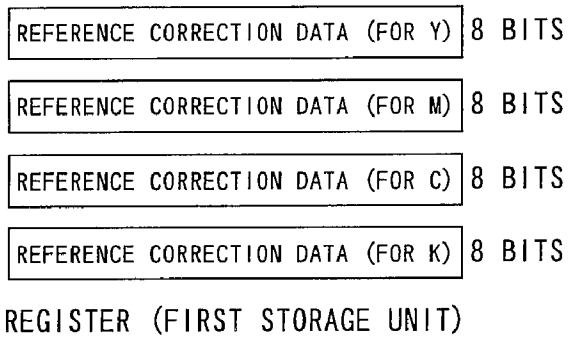
FIGS. 10A to 10C are views for explaining a third operation example of the light amount correction unit according to the first embodiment.
Figure 10B:
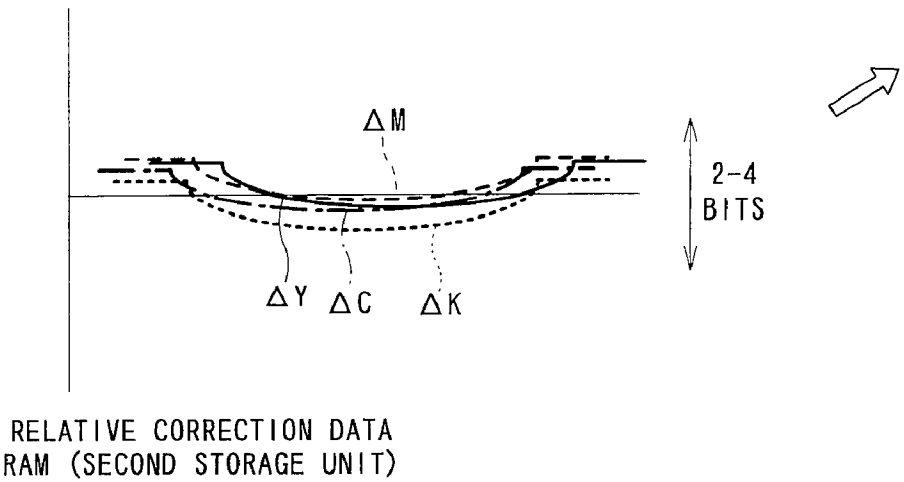
Figure 10C:
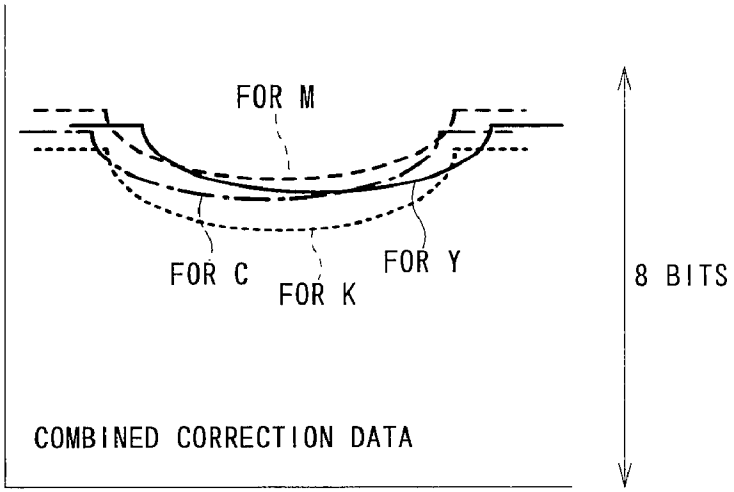
Figure 11B:
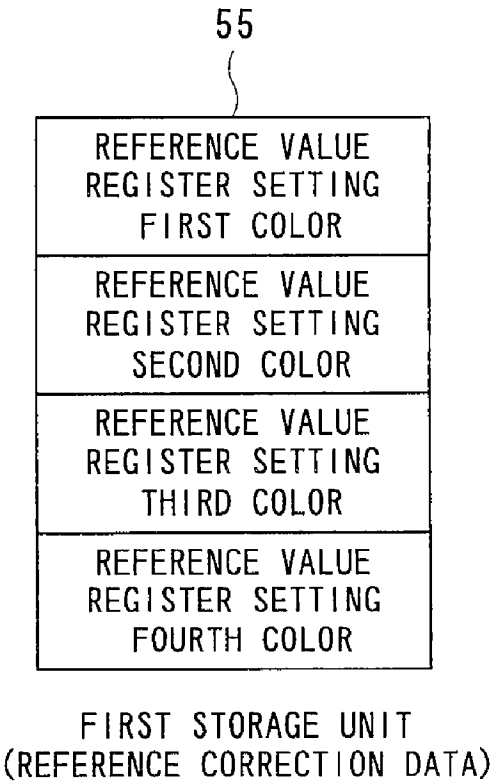
FIGS. 11A and 11B are views showing a memory allocation example, corresponding to a third operation example, of the first and the second storage units according to the first embodiment.
Figure 11A:
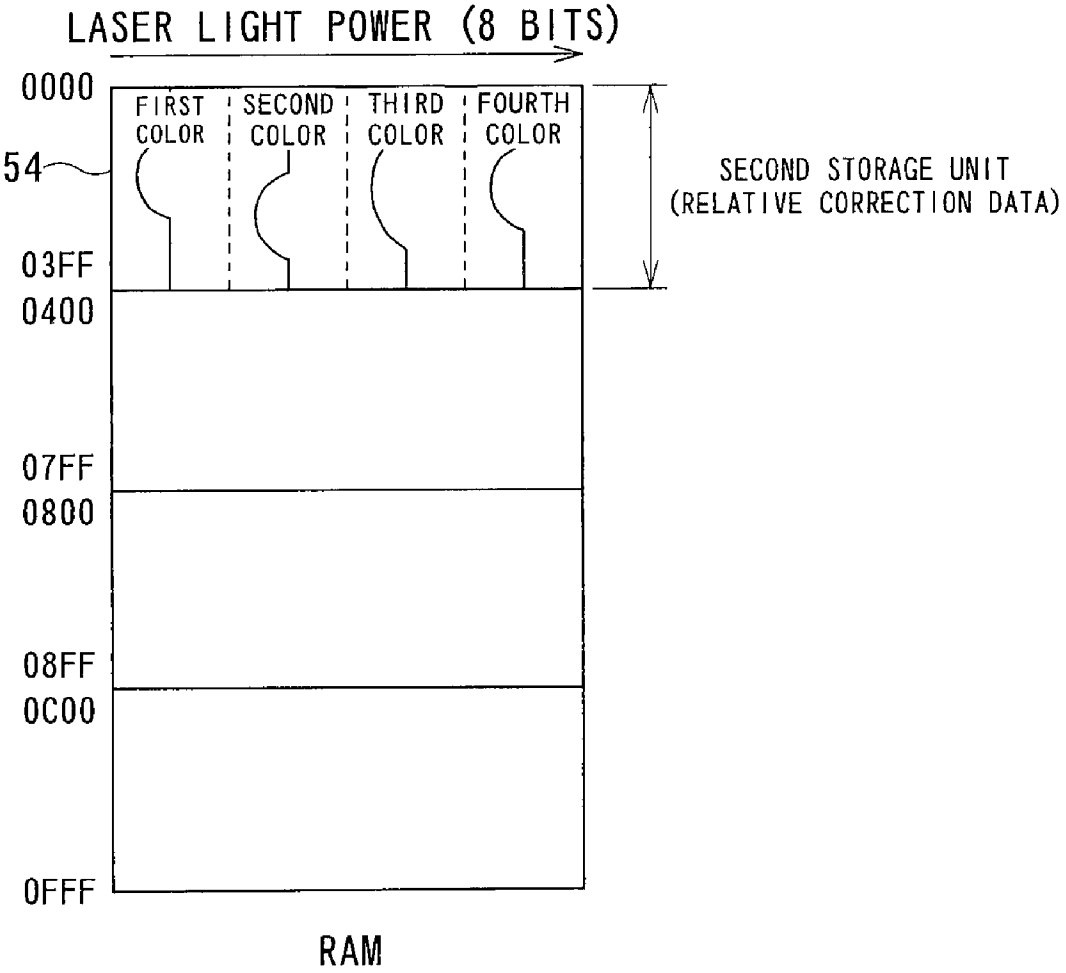

In this case, although the reference correction data have four values, also in this case, it is not necessary to store them in the RAM, and as shown in FIG. 10A or 11B, they may be stored in four registers, and the RAM area can be saved.

In the latter mode, although the number of registers is increased from 1 to 4, with respect to the relative correction data, since the basis of the difference data is the average value or the center value of each of the light amount correction data, the value of the difference data can be small as compared with the former mode, and accordingly, the saving effect of the RAM area becomes high.

(3) Light Amount Correction (Second Embodiment)

Figure 12:
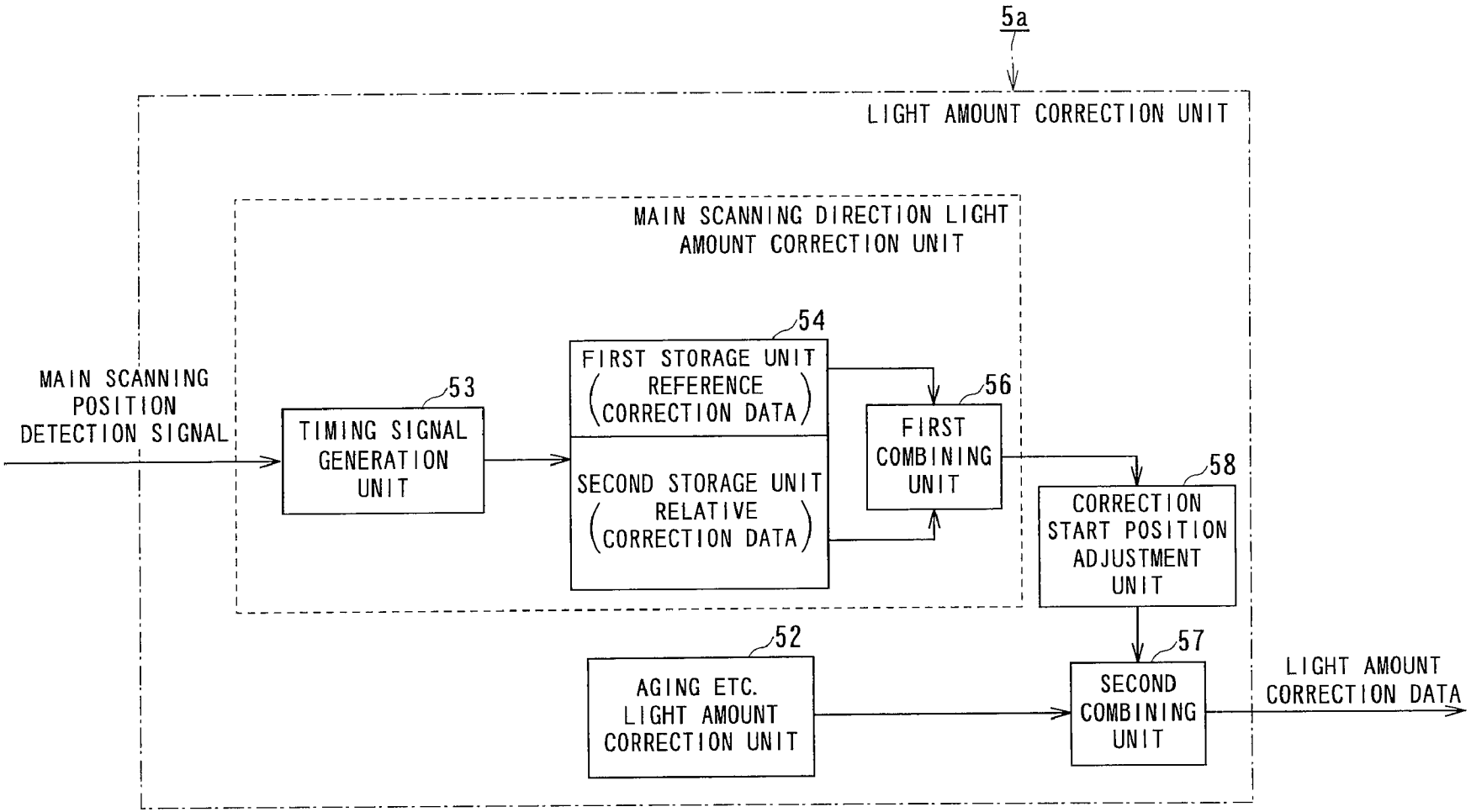
FIG. 12 is a view showing a structural example of a light amount correction unit according to a second embodiment of the invention.
Figure 13A:
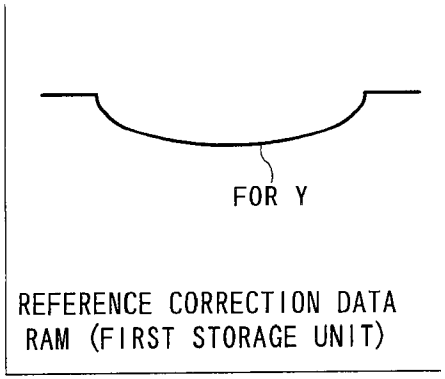
FIGS. 13A to 13D are views for explaining an operation example of the light amount correction unit according to the second embodiment.
Figure 13B:
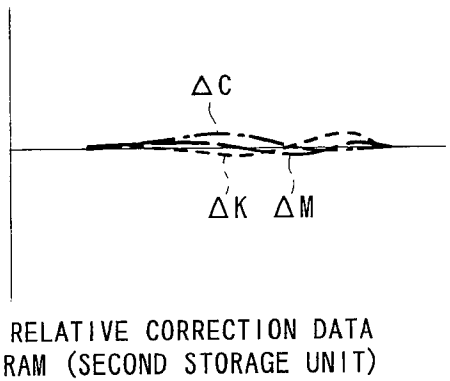
Figure 13C:
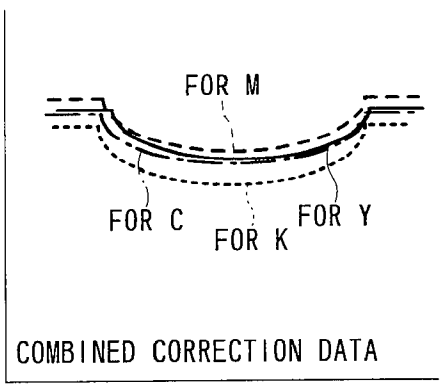
Figure 13D:
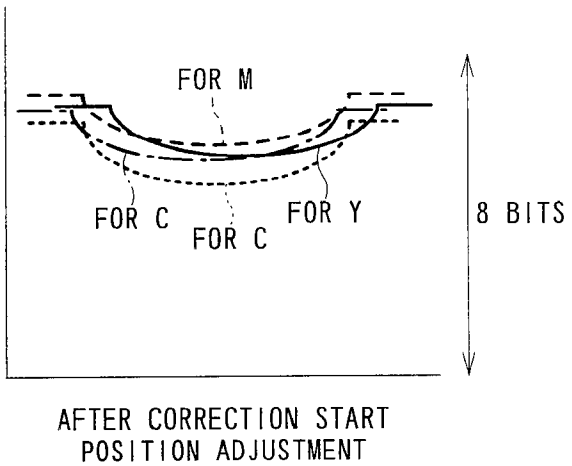

FIG. 12 is a view showing a structural example of a light amount correction unit 5*a* according to a second embodiment. A different point from the first embodiment is that a correction start position adjustment unit 58 is provided at the output of a first combining unit.

According to contents of light amount correction curves, since correction start positions of respective colors are mutually shifted, there is a case where although the shapes themselves of the correction curves are very close to each other, different kinds of correction data must be eventually held for the respective colors.

In such a case, there is a case where only one light amount correction curve is stored in the RAM, and desired light amount correction data to the respective colors can be created by shifting the correction start positions of the respective colors with respect to the read output.

Besides, even if the shapes of the correction curves are not completely coincident with each other, the value of the relative correction data can be made small by adding the function (function of the correction start position adjustment unit 58) to shift the correction start position.

FIGS. 13A to 13D are views for explaining an operation in which the function of the correction start position adjustment unit 58 is added to the correction (correction of the mode shown in FIG. 6) of such a mode that light amount correction data for Y is taken as reference correction data and difference data (ΔM, ΔC and ΔK) relative to the light amount correction data for Y are taken as relative correction data.

Among the difference data of the respective colors, since the difference (shift amount) in the main scanning direction is corrected by the correction start position adjustment unit 58, as the relative correction data to be stored in the second storage unit 55, only the difference in an amplitude direction may be stored, and as a result, the storage capacity can be further saved.

As described above, according to the image forming apparatus of the embodiment and the image forming method (light amount correction method), in the image forming apparatus of the electrophotographic system, the light amount correction in the main scanning direction of the laser light to expose the photoconductive body can be realized with a small memory capacity while the correction accuracy is maintained.

It should be understood that the present invention is by no means restricted to the above-described embodiments; rather, in carrying out the invention, various alterations and modifications may be made with regard to the components without departing from the spirit and scope of the present invention.

Further, various arrangements may be made within the scope of the present invention by arranging the components in various ways, or by omitting one or more of the components. Moreover, arrangements obtained by suitably combining the components of the above-described embodiments with components of other embodiments according to the present invention are also encompassed by the present invention.

What is claimed is:

1. An image forming apparatus comprising:

plural photoconductive bodies for forming a color image;

an exposure unit configured to scan a laser light in a main scanning direction of each of the plural photoconductive bodies and to perform exposure; and a light amount correction unit configured to create, for each of the plural photoconductive bodies, light amount correction data for correcting a light amount of the laser light outputted from the exposure unit so that a light receiving sensitivity of each of the plural photoconductive bodies in the main scanning direction becomes uniform, wherein the light amount correction unit includes a first storage unit configured to store reference correction data, a second storage unit configured to store relative correction data represented, when the reference correction data is made an absolute amount, by a relative amount correspondingly to each of the plural photoconductive bodies, and a combining unit configured to combine the reference correction data and the relative correction data to create the light amount correction data.

2. The image forming apparatus according to claim 1, wherein the reference correction data is correction data common to the light amount correction data different from each other for the respective plural photoconductive bodies, and the relative correction data are difference data between the reference correction data and the light amount correction data different for the respective plural photoconductive bodies.

3. The image forming apparatus according to claim 2, wherein the first storage unit and the second storage unit include specified divided areas of a random access memory, one light amount correction data selected among the plural light amount correction data is stored in the first storage unit, and in the second storage unit, the difference data are stored in areas different for the respective plural photoconductive bodies, and a storage capacity of each of the areas is smaller than a capacity of the first storage unit.

4. The image forming apparatus according to claim 2, wherein the reference correction data is fixed correction data to indicate a constant value in the main scanning direction, the first storage unit includes one register, and the second storage unit includes a random access memory.

5. The image forming apparatus according to claim 1, wherein the reference correction data is plural fixed correction data which are different from each other for the respective plural photoconductive bodies and indicate constant values in the main scanning direction, and the relative correction data are difference data between the respective plural light amount correction data and the respective plural fixed correction data corresponding thereto.

6. The image forming apparatus according to claim 5, wherein the first storage unit includes plural registers, and the second storage unit includes a random access memory.

7. The image forming apparatus according to claim 1, further comprising a correction start position adjustment unit configured to shift correction start positions, in the main scanning direction, of the relative correction data corresponding to the respective plural photoconductive bodies to decrease a difference between the relative correction data.

8. An image forming method of an image forming apparatus including plural photoconductive bodies for forming a color image, and an exposure unit configured to scan a laser light in a main scanning direction of each of the plural photoconductive bodies and to perform exposure, the image forming method comprising:

a light amount correction step of creating, for each of the plural photoconductive bodies, light amount correction data for correcting a light amount of the laser light outputted from the exposure unit so that a light receiving sensitivity in the main scanning direction of each of the plural photoconductive bodies becomes uniform, wherein the light amount correction step comprises storing reference correction data into a first storage unit, storing relative correction data represented, when the reference correction data is made an absolute amount, by a relative amount into a second storage unit correspondingly to each of the plural photoconductive bodies, and combining the reference correction data and the relative correction data to create the light amount correction data.

9. The image forming method according to claim 8, wherein the reference correction data is correction data common to the light amount correction data different from each other for the respective plural photoconductive bodies, and the relative correction data are difference data between the reference correction data and the light amount correction data different for the respective plural photoconductive bodies.

10. The image forming method according to claim 9, wherein the first storage unit and the second storage unit include specified divided areas of a random access memory, one light amount correction data selected among the plural light amount correction data is stored in the first storage unit, and in the second storage unit, the difference data are stored in different areas different for the respective plural photoconductive bodies, and a storage capacity of each of the areas is smaller than a capacity of the first storage unit.

11. The image forming method according to claim 9, wherein the reference correction data is fixed correction data to indicate a constant value in the main scanning direction, the first storage unit includes one register, and the second storage unit includes a random access memory.

12. The image forming method according to claim 8, wherein the reference correction data is plural fixed correction data which are different for the respective plural photoconductive bodies and indicate constant values in the main scanning direction, and the relative correction data are difference data between the respective plural light amount correction data and the respective plural fixed correction data corresponding thereto.

13. The image forming method according to claim 12, wherein the first storage unit includes plural registers, and the second storage unit includes a random access memory.

14. The image forming method according to claim 8, further comprising a step of shifting correction start positions, in the main scanning direction, of the relative correction data corresponding to the respective plural photoconductive bodies to decrease a difference between the relative correction data.

* * * * *

UNITED STATES PATENT AND TRADEMARK OFFICE

CERTIFICATE OF CORRECTION

PATENT NO. : 7,535,483 B2
APPLICATION NO. : 11/459929
DATED : May 19, 2009
INVENTOR(S) : Takada et al.

It is certified that error appears in the above-identified patent and that said Letters Patent is hereby corrected as shown below:

Title Pg, Item (57) Abstract, line 8: replace “form” with --from--.

Title Pg, Item (57) Abstract, line 12: replace “reference” with --relative--.

Title Pg, Item (57) Abstract, line 13: replace “, a second” with --represented, when--.

Signed and Sealed this

Twenty-third Day of June, 2009

John Doll

JOHN DOLL
*Acting Director of the United States Patent and Trademark Office*